US007841868B2

(12) United States Patent
Tang et al.

(10) Patent No.: US 7,841,868 B2
(45) Date of Patent: Nov. 30, 2010

(54) SOCKET CONNECTOR HAVING POSITIONING MEMBERS FOR ORIENTATING COVER AND BASE THEREOF

(75) Inventors: Kun Tang, Shenzhen (CN); Jie-Feng Zhang, Shenzhen (CN); Wen He, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/535,852

(22) Filed: Aug. 5, 2009

(65) Prior Publication Data

US 2010/0035455 A1 Feb. 11, 2010

(51) Int. Cl.
*H01R 12/00* (2006.01)

(52) U.S. Cl. ..... 439/71; 439/342

(58) Field of Classification Search ..... None
See application file for complete search history.

(56) References Cited

U.S. PATENT DOCUMENTS 3,771,109 A * 11/1973 Bruckner et al. ..... 439/331
4,166,665 A * 9/1979 Cutchaw ..... 439/196
5,092,789 A * 3/1992 Sinclair ..... 439/259
6,338,639 B1 * 1/2002 Trout et al. ..... 439/342
6,425,768 B1 * 7/2002 Taylor ..... 439/67
6,450,824 B1 * 9/2002 Lemke et al. ..... 439/342
6,514,097 B1 * 2/2003 Conroy ..... 439/330
6,679,717 B2 1/2004 Zhang et al.
7,244,136 B2 * 7/2007 Hao ..... 439/342
7,318,736 B1 * 1/2008 Ambady ..... 439/259
7,362,581 B2 * 4/2008 Chen ..... 361/709
7,591,663 B2 * 9/2009 Lu ..... 439/342
2004/0005800 A1 * 1/2004 Hou ..... 439/342
2009/0061673 A1 * 3/2009 Zhang et al. ..... 439/342

* cited by examiner

*Primary Examiner*—Michael C Zarroli
(74) *Attorney, Agent, or Firm*—Andrew C. Cheng; Wei Te Chung; Ming Chieh Chang

(57) ABSTRACT

A socket connector (1) for electrically connecting a Central Processing Unit (CPU) with a Printed Circuit Board (PCB), includes a base (10), a cover (20) and a shaft (30) attached to the cover and pivotally driving the cover to move on the base. The base has a plurality of conductive contacts received therein and defines a plurality of apertures (104) in the middle thereof. The cover forms a plurality of pillars (208) extending through the apertures and forward a lower surface of the base. The pillars are moveable in the apertures along with the cover.

8 Claims, 6 Drawing Sheets

SOCKET CONNECTOR HAVING POSITIONING MEMBERS FOR ORIENTATING COVER AND BASE THEREOF

BACKGROUND OF THE INVENTION

1. Field of the Invention

The present invention relates generally to a socket connector, and more particularly to a socket connector having positioning members for orientating cover and base thereof.

2. Description of Related Arts

As known publicly, a Central Processing Unit (CPU) functions as a heart of the computer, which deals with and operates pluralities of data in the computer. Such a CPU is usually connected with a printed circuit board (PCB) by a socket connector, which is soldered with the PCB and receives the CPU. The socket connector comprises a plurality of conductive contacts soldering with the electrical pads of the PCB while the CPU comprises a plurality of electrical pins corresponding to the conductive contacts of the socket connector so as to contact with the conductive contacts for data communication. According to varieties of packing forms of the CPUs, the socket connectors form different structures for receiving different CPUs. With a development of the semiconductor technology, a sort of socket connector with zero insertion force appears. Such kind of socket connector comprises a base in a lower level, a cover shielding over the base in an upper level and a shaft pivoting for driving the cover to move on the base. The base defines a plurality of passageways for receiving the conductive contacts. The passageways are usually arranged in a matrix. The cover defines a plurality of slots, each slot corresponding to one conductive contact. When the socket connector is not in use, the slot is superpositioned on the corresponding passageway, i.e. the slot is located above each conductive contact. The conductive contact comprises a base portion, a pair of wing portions extending from two lateral sides of the base portion to define a first larger receiving room therebetween and a pair of contact portions at the distal ends of the wing portions for defining a second smaller receiving room therebeween. When the CPU are laid on an upper surface of the cover, each pin of the CPU is conveniently inserted through the slot of the cover into the first larger receiving room, an electrical connection is not achieved; and then, the cover moves on the base by pivoting the shaft to drive the pin of the CPU to move from the first larger receiving room towards the second smaller receiving room that at last, the pin is compressed by the contact portions of the conductive contact. An electrical connection between the CPU and the conductive contact is achieved.

However, such kind of socket connector with zero insertion force is usually soldered to the PCB in an Infra-Red soldering process. In the Infra-Red soldering process, the base and the cover of the socket connector are probably warped under so high temperature. Moreover, the cover is attached to the base only by two frames of the cover on two lateral sides thereof interfering with a plurality of protrusions formed on two lateral sides of the base. Therefore, the cover is positioned to the base loosely. The aforementioned mentions may cause damage to the electrical connection between the CPU and the conductive contacts.

Hence, an improved socket connector having positioning members for orientating cover and base thereof and thereby achieving a good electrical connection between the contacts and the CPU is desired.

SUMMARY OF THE INVENTION

Accordingly, an object of the present invention is to provide a socket connector having positioning members for orientating cover and base thereof and thereby achieving a good electrical connection between the contacts and the CPU.

To achieve the above object, an electrical connector for electrically connecting a Central Processing Unit (CPU) with a Printed Circuit Board (PCB), includes a base, a cover and a shaft attached to the cover and pivotally driving the cover to move on the base. The base has a plurality of conductive contacts received therein and defines a plurality of apertures in the middle thereof. The cover forms a plurality of pillars extending through the apertures and forward a lower surface of the base. The pillars are moveable in the apertures along with the cover.

Other objects, advantages and novel features of the invention will become more apparent from the following detailed description when taken in conjunction with the accompanying drawings.

DETAILED DESCRIPTION OF THE PREFERRED EMBODIMENT

Figure 1:
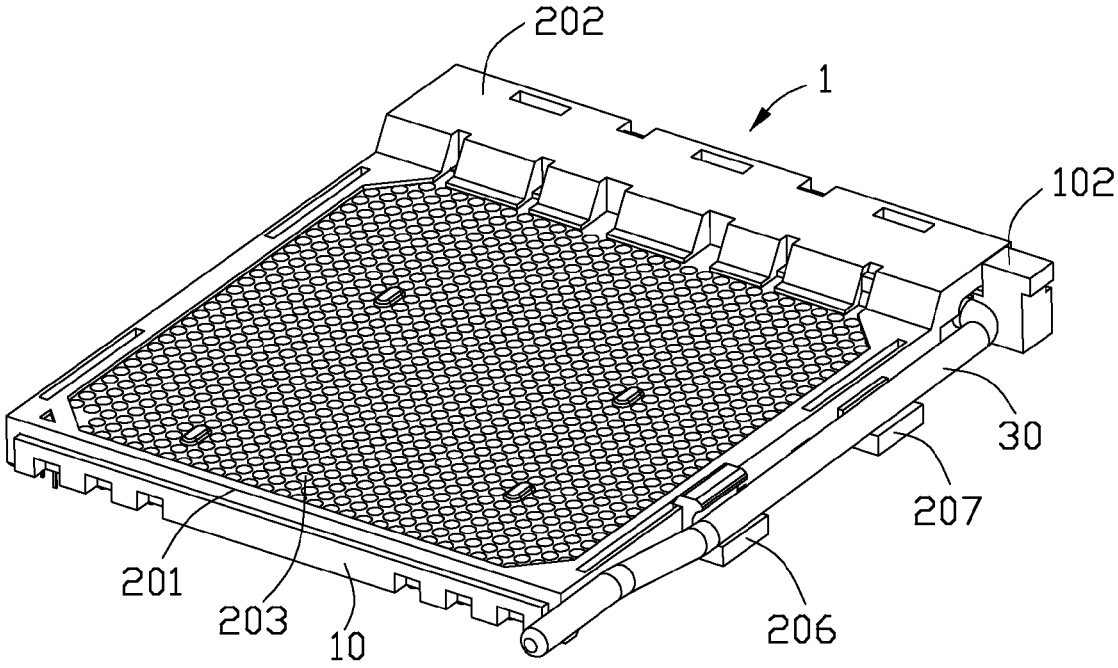
FIG. 1 is a perspective, assembled view of a socket connector according to the present invention.
Figure 2:
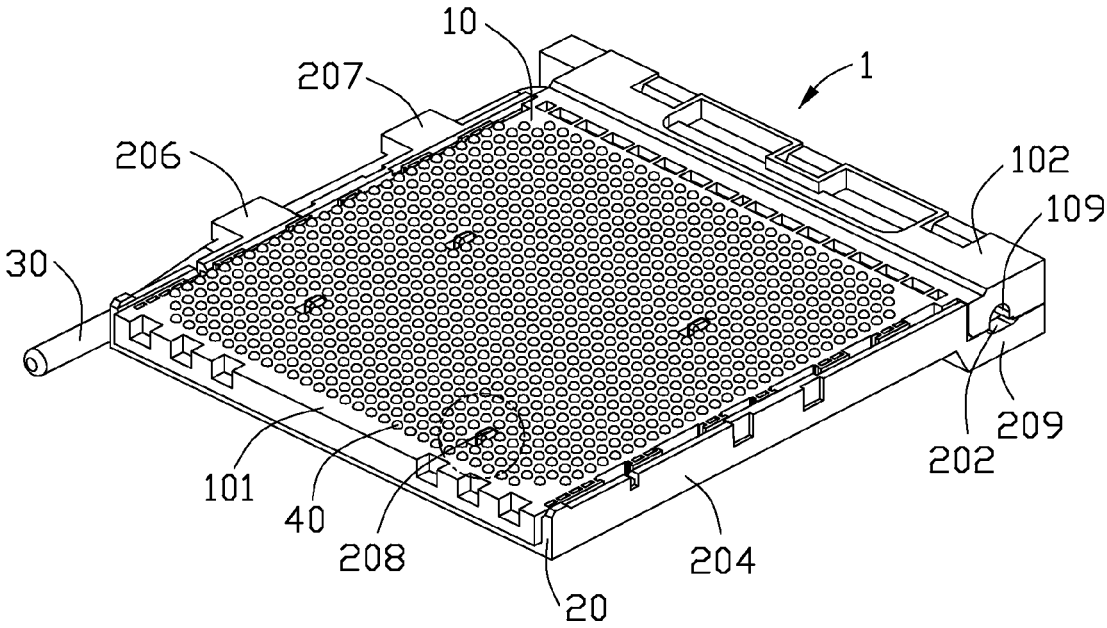
FIG. 2 is another perspective, assembled view of FIG. 1.

FIGS. 1-4 illustrate a socket connector 1 in accordance with the present invention, used for connecting a Central Processing Unit (CPU) (not shown) with a printed circuit board (PCB) (not shown) to transmit signals therebetween. The socket connector 1 comprises a base 10 in a lower level, a cover 20 shielding over the base 10 in an upper level, a plurality of conductive contacts (not shown) received in the base 10 and a shaft 30 laterally attaching to the base 10 and the cover 20 and pivoting for driving the cover 20 to move on the base 10. The socket connector 1 is soldered on the PCB by solder balls 40 which are located below the base 10 and electrically connected with the conductive contacts.

Figure 3:
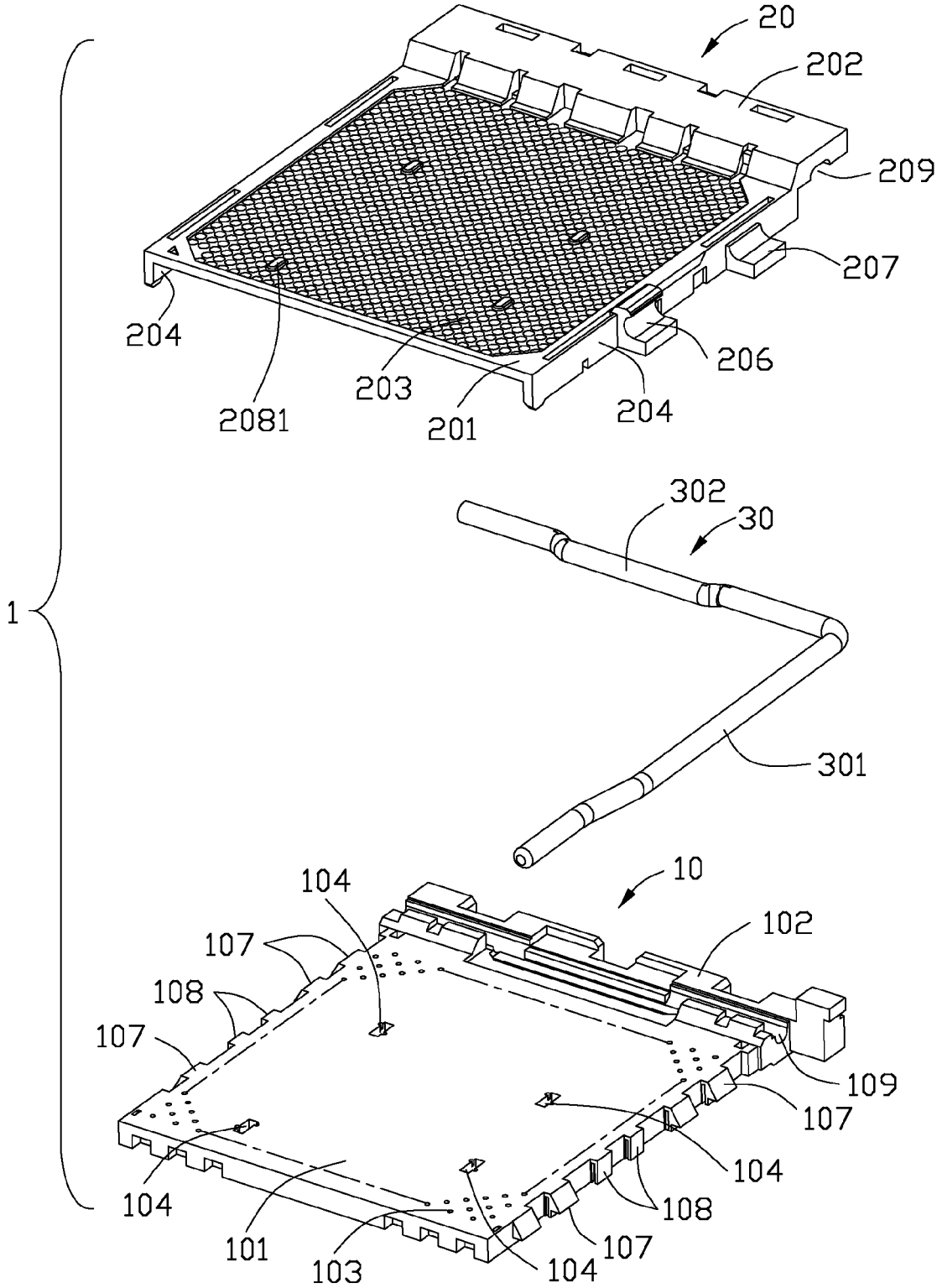
FIG. 3 is a perspective, disassembled view of the socket connector without the conductive contacts and the solder balls soldered with the conductive contacts.
Figure 4:
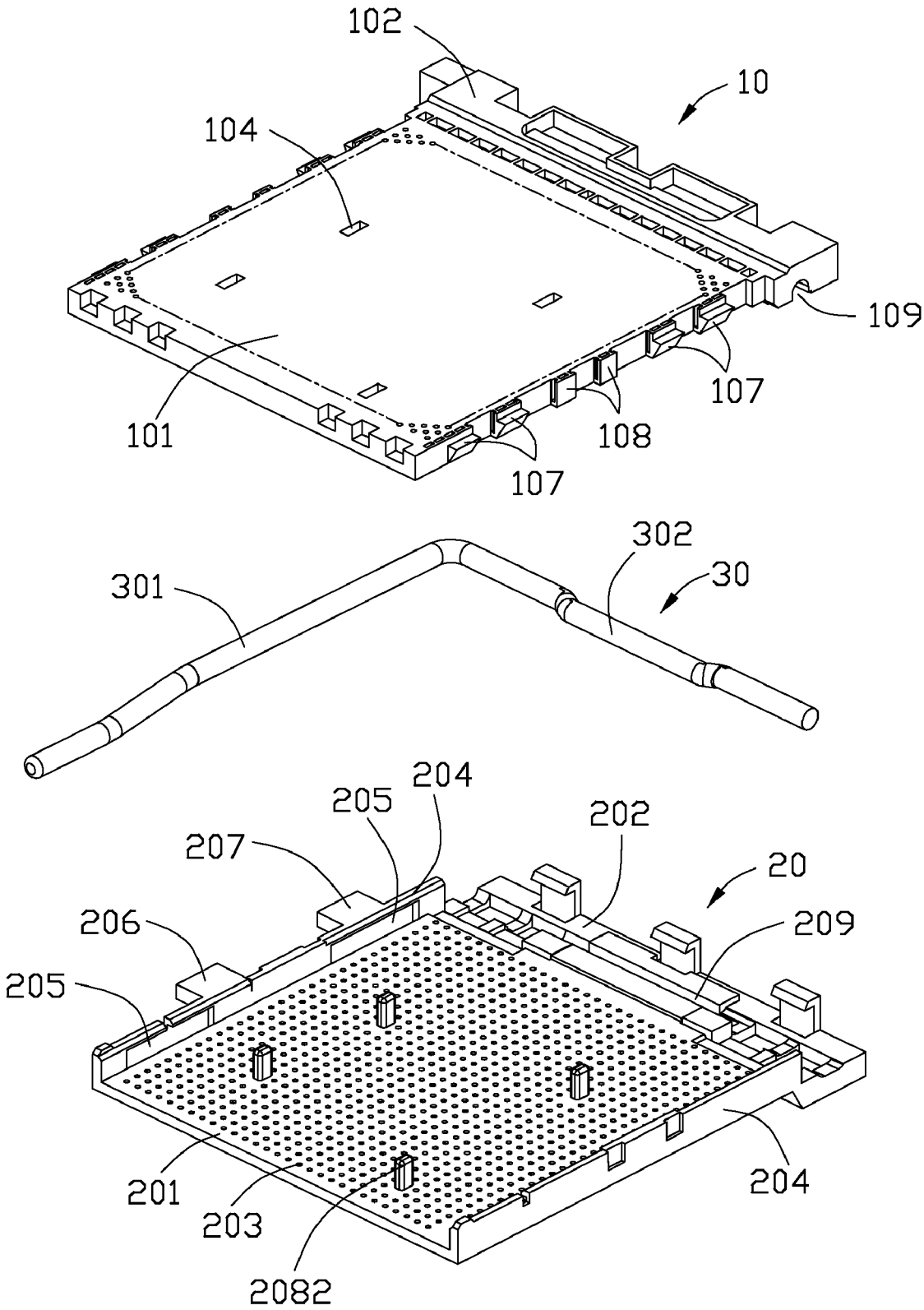
FIG. 4 is another perspective, disassembled view of FIG. 3.
Figure 5:
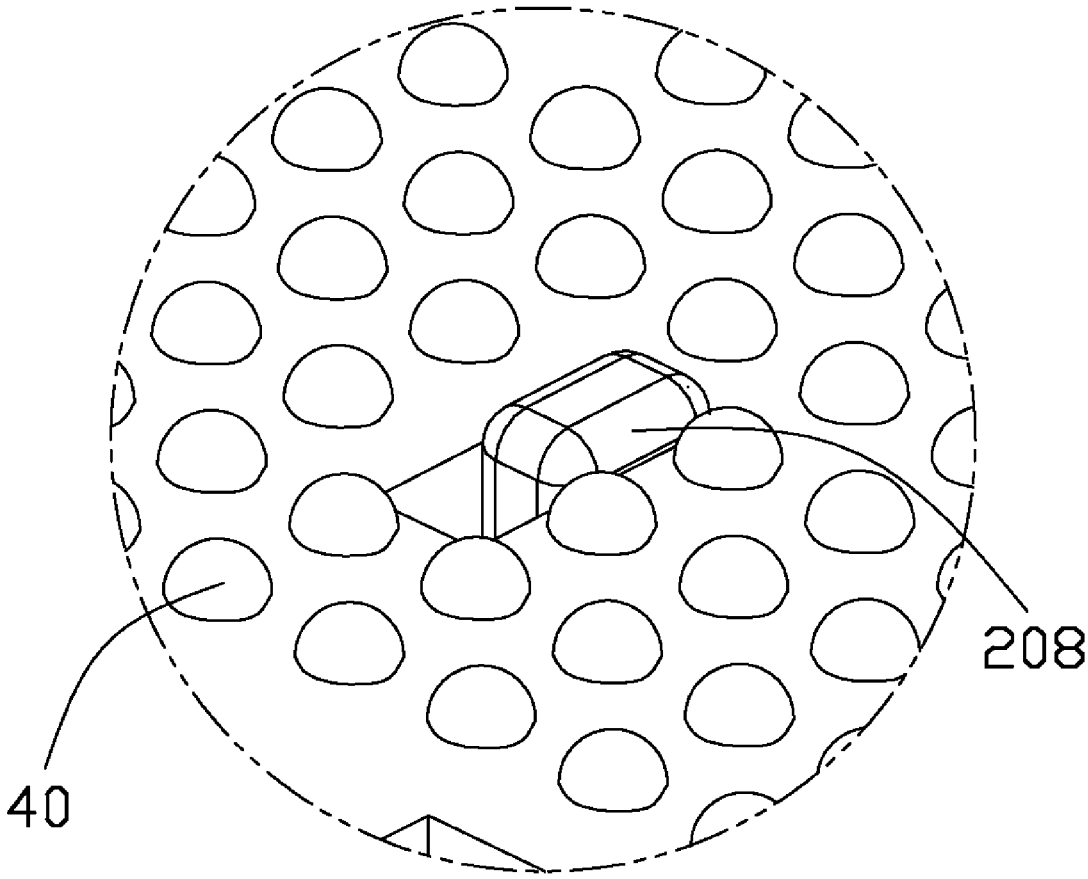
FIG. 5 is a partly amplified view of the socket connector of FIG. 2.
Figure 6:
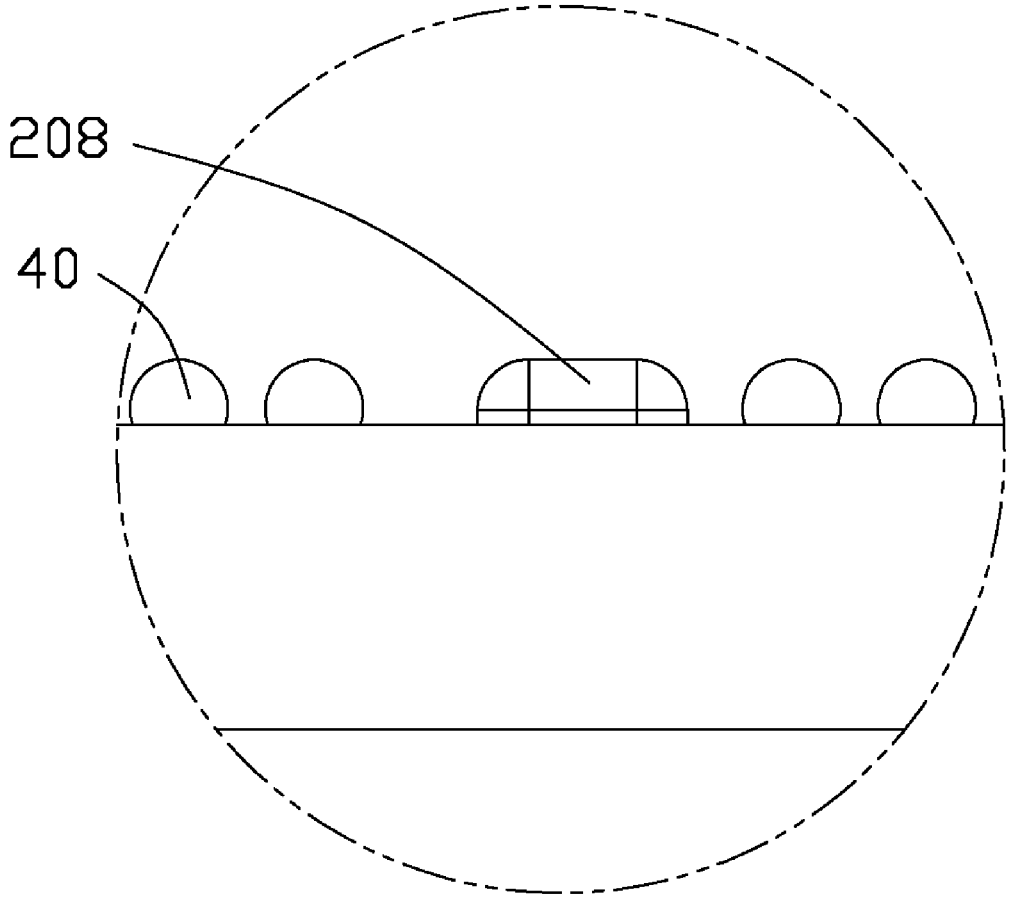
FIG. 6 is a side view of FIG. 5.

Referring to FIGS. 3 and 4, the base 10 has a rectangle shape, comprising a retaining portion 101 and a receiving portion 102 at a rear side of the retaining portion 101 taking along a front-to-rear direction. The retaining portion 101 defines a plurality of passageways 103 for retaining the conductive contacts therein. The retaining portion 101 defines four apertures 104 in a middle part thereof. The four apertures 104 are arranged at four vertexes of a quadrangle with a smaller size than the base 10. The central point of the base 10 prefers to be situated in the quadrangle defined by the apertures 104. The number of the apertures 104 is not limiting in four, other numbers are also feasible, anyway, the apertures 104 are arranged at vertexes of a polygon and the central point of the base 10 prefers to be situated in the polygon defined by the apertures 104. The base 10 forms at least two lugs 107 outwardly at the lateral sides thereof and a pair of protrusions 108 located between the two lugs 107. The receiving portion 102 is a long-narrow one which extends along a left-and-right direction. The receiving portion 102 defines a first recess 109 from the left to the right for partly receiving the shaft 30. A transverse section of the first recess 109 is a semicircle.

As is indicated in FIGS. 3 and 4, the cover 20 has a rectangle shape too, defining a top face confronting the CPU and a bottom face confronting the base. The cover 20 comprises a base portion 201 and a head portion 202 at a rear side of the base portion 201. The base portion 201 and the head portion 202 are arranged in different levels, while the head portion 202 is located above the base portion 201. The base portion 201 defines a plurality of slots 203, each corresponding to one passageway 103 of the base 10. The base portion 201 forms four pillars 208 integrally extending therefrom. Each pillar 208 has a short upward protrusion 2081 unitarily extending from an upper face of the cover 20 and a long downward protrusion 2082 unitarily extending from a lower face of the cover 20 in vertical alignment with the short upward protrusion 2081. A pair of lateral walls 204 also extends downwardly from the opposite edges of the base portion 201. Each lateral wall 204 defines two recessed portions 205 at inner surfaces thereof. The recessed portions 205 of one lateral wall 204 face towards the ones of the other lateral wall 204. One lateral wall 204 forms a locking portion 206 at a front part thereof and extending outwardly therefrom. The lateral wall 204 further comprises a supporting portion 207 at a rear part thereof for releasing friction force to the shaft 30. The head portion 202 is also a long-narrow one which extends along the left-and-right direction as the receiving portion 102. The head portion 202 defines a second recess 209 from the left to the right for partly receiving the shaft 30. A transverse section of the second recess 209 is also a semicircle. The first and second recesses 109, 209 are combined to be a column receiving space.

Referring to FIGS. 3 and 4, the shaft 30 comprises a driving portion 301 extending along the front-to-rear direction and an active portion 302 extending along the left-and-right direction. The driving portion 301 is locked with the locking portion 206 of the cover 20 and is supported by the supporting portion 207. The active portion 302 is received in the column receiving space defined by the first and second recesses 109, 209. A user can push the shaft 30 and then drives the cover 20 to move on the base 10. The lugs 107 of the base 10 are received in the recessed portions 205 of the cover 20 and move in the recessed portions 205 when the cover 20 moves on the base 10. The lugs 107 provide orientation force between the cover 20 and the base 10. The long downward protrusions 2082 of the pillars 208 of the cover 20 are received in the apertures 104 of the base 10 and move in the apertures 104 when the cover 20 moves on the base 10. The pillars 208 provide more orientation force between the cover 20 and the base 10 so as to achieve good electrical connection between the CPU and the conductive contacts though under high temperature in the Infra-Red soldering process. The solder balls are located in a first plane, and the pillar 208 extends outside of the base 10 to the first plane to perform as a standoff.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A socket connector for electrically connecting a Central Processing Unit (CPU) with a Printed Circuit Board (PCB), comprising:

a base with a plurality of conductive contacts received therein defining a plurality of apertures in the middle thereof, the base comprising at least two lugs at lateral sides thereof and a receiving portion at a rear part thereof, the receiving portion defining a first recess;

a cover forming a plurality of pillars extending through the apertures and toward a lower surface of the base, the cover comprising a pair of lateral walls defining a plurality of recessed portions at inner surfaces thereof such that the lugs are moveably received in the recessed portions, the cover comprising a head portion corresponding to the receiving portion, the head portion defining a second recess, both transverse sections of the recesses semicircle-shaped and the recesses combining a column receiving space, the cover forming a locking portion at a lateral side thereof; and a shaft pivotally driving the cover to move on the base along a front-to-back direction, the shaft comprising an active portion received in the column receiving space and a driving portion capable of being locked with the locking portion of the cover;

wherein the pillars are moveable in the apertures along with the cover in the front-to-back direction, both the rear part and the head portion extend along a transverse direction relative to the front-to-back direction.

2. The socket connector as described in claim 1, wherein the cover further forms a supporting portion at the same lateral wall as the locking portion to support the shaft.

3. An electrical connector for electrically connecting a Central Processing Unit (CPU) to a main board, comprising:

a first housing defining a plurality of first passageways and at least one aperture defined among the passageways;

a second housing attached to the first housing and moveable along a front-to-back direction with respect to the first housing, the second housing defining a plurality of second passageways therethrough;

at least one protrusion extending from the second housing towards the first housing and moveably received in the at least one aperture of the first housing along the front-to-back direction; and a plurality of contacts disposed in one of the first housing and the second housing, each contact having a solder ball attached thereto which is located in a first plane; wherein the at least one protrusion has a distal end extending outside of the first housing to the first plane to perform as a standoff.

4. The electrical connector as described in claim 3, wherein the second housing defines a top face confronting the CPU and a bottom face confronting the first housing.

5. The electrical connector as described in claim 3, further comprising a shaft attached to the first housing and the second housing and pivotally driving one of the housings to move with respect to the other.

6. An electrical connector comprising:

an insulative base defining a plurality of passageways extending therethrough in a vertical direction;

a plurality of contacts disposed in the corresponding passageways, respectively;

an insulative cover with lateral walls defining an area with a plurality of through holes in vertical alignment with the corresponding passageways, respectively, said cover being moveable relative to the base along a front-to-back direction;

a plurality of pillars mounted within the area of the cover through holes and not as part of the cover lateral walls, each pillar has a short upward protrusion unitarily extending from an upper face of the cover and;

each pillar also has a long downward protrusion unitarily extending from a lower face of the cover in vertical alignment with the corresponding short upward protrusions, respectively.

7. The electrical connector as claimed in claim 6, wherein said base is further equipped with a plurality of passages extending therethrough in said vertical direction under condition that said passages are larger than the passageways and receive said downward protrusions therein.

8. The electrical connector as claimed in claim 6, wherein said base is further equipped with a plurality of passages and the long downward protrusions extend outside of the base throughout the passages, respectively.

* * * * *